US010819069B2

(12) United States Patent
Zhang et al.

(10) Patent No.: US 10,819,069 B2
(45) Date of Patent: Oct. 27, 2020

(54) RADIO FREQUENCY CONNECTOR

(71) Applicant: HUAWEI TECHNOLOGIES CO., LTD., Shenzhen, Guangdong (CN)

(72) Inventors: Runxiao Zhang, Dongguan (CN); Zhiming Yang, Dongguan (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/598,453

(22) Filed: Oct. 10, 2019

(65) Prior Publication Data

US 2020/0044390 A1 Feb. 6, 2020

Related U.S. Application Data

(63) Continuation of application No. PCT/CN2018/082447, filed on Apr. 10, 2018.

(30) Foreign Application Priority Data

Apr. 13, 2017 (CN) ..... 2017 1 0240580

(51) Int. Cl.
*H01R 13/631* (2006.01)
*H01Q 1/42* (2006.01)
(Continued)

(52) U.S. Cl.
CPC ..... *H01R 13/631* (2013.01); *H01Q 1/42* (2013.01); *H01R 13/621* (2013.01);
(Continued)

(58) Field of Classification Search
CPC .... H01R 13/631; H01R 13/621; H01R 13/64; H01R 24/40; H01R 2103/00; H01R 12/91;
(Continued)

(56) References Cited

U.S. PATENT DOCUMENTS 3,088,089 A * 4/1963 Gregoire ..... H01R 13/631 439/272
4,815,986 A 3/1989 Dholoo
(Continued)

FOREIGN PATENT DOCUMENTS

CN 2501201 Y 7/2002
CN 201450195 U 5/2010
(Continued)

*Primary Examiner* — Travis S Chambers
(74) *Attorney, Agent, or Firm* — Womble Bond Dickinson (US) LLP

(57) ABSTRACT

A radio frequency connector includes: a support portion, where the support portion is disposed in a male connector of the radio frequency connector, and the support portion is configured to connect the male connector to a ground cable of transmission lines of a feeding network; a first external conductor disposed in the male connector of the radio frequency connector, where the first external conductor is connected to the support portion; and a first inner conductor disposed in the male connector of the radio frequency connector, where the first inner conductor is disposed inside the first external conductor, an axis of the first inner conductor coincides with an axis of the first external conductor, the first inner conductor is connected to the support portion by using a first elastic element, and the first inner conductor moves in an axial direction of the external conductor through deformation of the first elastic element.

15 Claims, 5 Drawing Sheets

(51) Int. Cl.
*H01R 13/621* (2006.01)
*H01R 13/64* (2006.01)
*H01R 24/40* (2011.01)
*H01R 103/00* (2006.01)

(52) U.S. Cl.
CPC ..... *H01R 13/6315* (2013.01); *H01R 13/64* (2013.01); *H01R 24/40* (2013.01); *H01R 2103/00* (2013.01)

(58) Field of Classification Search
CPC ..... H01R 2201/02; H01R 13/6315; H01R 24/38; H01Q 1/42
USPC ..... 439/359, 246–248
See application file for complete search history.

(56) References Cited

U.S. PATENT DOCUMENTS 5,516,303 A * 5/1996 Yohn ..... H01R 13/6315 439/248
5,769,652 A 6/1998 Wider
6,699,054 B1 * 3/2004 Critelli ..... H01R 13/6315 439/248
7,422,456 B1 * 9/2008 Mitani ..... H01R 13/6315 439/247
2002/0098730 A1 * 7/2002 Babala ..... G01L 19/003 439/248
2010/0210129 A1 * 8/2010 Arts ..... H01R 13/6315 439/248
2017/0310005 A1 10/2017 Kang et al.

FOREIGN PATENT DOCUMENTS

CN 201623326 U 11/2010
CN 102570185 A 7/2012
CN 103414057 A 11/2013
CN 104183978 A 12/2014
CN 204243344 U 4/2015
CN 106229775 A 12/2016
EP 2688156 A1 1/2014

* cited by examiner

RADIO FREQUENCY CONNECTOR

CROSS-REFERENCE TO RELATED APPLICATIONS

This application is a continuation of International Application No. PCT/CN2018/082447, filed on Apr. 10, 2018, which claims priority to Chinese Patent Application No. 201710240580.5, filed on Apr. 13, 2017. The disclosures of the aforementioned applications are hereby incorporated by reference in their entireties.

TECHNICAL FIELD

This application relates to the communications field, and more particularly, to a radio frequency connector.

BACKGROUND

To implement insertion or removal of function modules in a device, usually a plurality of radio frequency connectors need to be integrated on one module (for example, one radio frequency module), and simultaneous on or off of a plurality of signals is implemented through one time of insertion or removal of the module. During interconnection and fit between a male connector of the radio frequency connector and a female connector of the radio frequency connector, because of impact of a factor such as a size error of a part, namely, an assembly error, fit clearances between the male connectors of the radio frequency connector and the female connectors of the radio frequency connector are not all consistent. Different fit clearances cause inconsistent electrical strengths obtained through interconnection between the male connector of the radio frequency connector and the female connector of the radio frequency connector. As a result, operating performance of the radio frequency connector is affected. Even worse, the foregoing factor such as the size error of the part, namely, the assembly error may cause a failure in interconnection (fit) between the male connector of the radio frequency connector and the female connector of the radio frequency connector, and consequently the radio frequency connector cannot operate.

Currently, an external conductor structure such as a separated clamp spring plate is used for a floating connector in the prior art. However, when most of the radio frequency connectors are fastened by using support spring coils during mounting, volumes of housings mounted for the radio frequency connectors are required to be relatively large, which does not adapt to a development tendency of product miniaturization.

SUMMARY

This application provides a radio frequency connector, to reduce a volume of the radio frequency connector.

According to a first aspect, a radio frequency connector is provided. The radio frequency connector includes: a support portion, where the support portion is disposed in a male connector of the radio frequency connector, and the support portion is configured to connect the male connector of the radio frequency connector to a ground cable of transmission lines of a feeding network; a first external conductor disposed in the male connector of the radio frequency connector, where the first external conductor is connected to the support portion; and a first inner conductor disposed in the male connector of the radio frequency connector, where the first inner conductor is disposed inside the first external conductor, an axis of the first inner conductor coincides with an axis of the first external conductor, the first inner conductor is connected to the support portion by using a first elastic element, and the first inner conductor moves in an axial direction of the external conductor through deformation of the first elastic element.

The first elastic element is disposed between the first inner conductor and a core sleeve, thereby avoiding a relatively large volume of a housing mounted for the radio frequency connector because of use of a support spring coil for fastening in the prior art, to reduce a volume of the radio frequency connector.

Further, the first elastic element is disposed between the first inner conductor and the core sleeve, to improve a tolerance capability of the male connector of the radio frequency connector and a female connector of the radio frequency connector in an axial direction during assembly, so that the male connector of the radio frequency connector may be connected to the female connector of the radio frequency connector in a manner of blind-mating, which helps improve assembly efficiency during assembly of the radio frequency connector.

With reference to the first aspect, in some embodiments of the first aspect, the radio frequency connector further includes at least one first fastener. The at least one first fastener is disposed on the first external conductor. A second elastic element is disposed between each of the at least one first fastener and the first external conductor. An axis of the at least one first fastener remains parallel to the axis of the first external conductor through deformation of the second elastic element.

In this embodiment of this application, the second elastic element is disposed between each first fastener and the first external conductor. Through the deformation of the second elastic element, an axis of the first fastener is enabled to be approximately parallel to the axis of the first external conductor, which helps improve a tolerance capability between the first fastener and the first external conductor on the radio frequency connector in a radial direction.

Further, the second elastic element is disposed between each first fastener and the first external conductor, to improve a tolerance capability of the male connector of the radio frequency connector and the female connector of the radio frequency connector in the radial direction during assembly, so that the male connector of the radio frequency connector is connected to the female connector of the radio frequency connector in a manner of blind-mating, which helps improve the assembly efficiency during assembly of the radio frequency connector.

With reference to the first aspect, in some embodiments of the first aspect, the support portion includes a support frame and a core sleeve. At least one second fastener is disposed on the support frame. At least one protrusion portion is disposed on each of the at least one second fastener. At least one groove is disposed on each of the at least one first fastener. Each second fastener disposed on the support frame is connected to each first fastener disposed on the first external conductor through fit between the protrusion portion and the groove. The core sleeve is connected to the first external conductor by using the support frame. The core sleeve is connected to the first inner conductor by using the first elastic element.

With reference to the first aspect, in some embodiments of the first aspect, the radio frequency connector further includes a first stop block. The first stop block is disposed between the first external conductor and the first inner conductor, to control the axis of the first inner conductor to coincide with the axis of the first external conductor.

The first stop block is disposed between the first external conductor and the first inner conductor, so that the first external conductor and the first inner conductor are coaxial, thereby ensuring, to an extent, locations of the first external conductor and the first inner conductor that are relative to each other and that are required by a radio frequency parameter required by the radio frequency connector, and helping improve radio frequency conduction performance of the radio frequency connector.

With reference to the first aspect, in some embodiments of the first aspect, the radio frequency connector further includes a core connecting piece. The core connecting piece is configured to connect the core sleeve to a signal cable of the feeding network in an antenna.

In one embodiment, the foregoing core connecting piece may be a metal piece, or may be a nonmetallic piece on which conductive surface treatment is performed.

With reference to the first aspect, in some embodiments of the first aspect, the radio frequency connector further includes an insulation washer. The insulation washer is disposed between the core sleeve and the first external conductor.

With reference to the first aspect, in some embodiments of the first aspect, the first elastic element is an elastic rod.

The elastic rod is disposed between the first inner conductor and the core sleeve to serve as the first elastic element, to help reduce the volume of the radio frequency connector.

In one embodiment, the first elastic element may be further a spring wire or a spring plate.

With reference to the first aspect, in some embodiments of the first aspect, the radio frequency connector further includes: a second external conductor, where the second external conductor is disposed in the female connector of the radio frequency connector; a second inner conductor disposed in the female connector of the radio frequency connector, where the second inner conductor is disposed inside the second external conductor; and a second stop block, where the second stop block is disposed between the second external conductor and the second inner conductor, to control an axis of the second external conductor to coincide with an axis of the second inner conductor.

With reference to the first aspect, in some embodiments of the first aspect, a convex shoulder is disposed on the first external conductor. The convex shoulder is connected to the first fastener by using the second elastic element. The convex shoulder fits the second external conductor, to control axial locations of the first external conductor and the second external conductor.

In some embodiments, the foregoing radio frequency connector may also be referred to as a floating connector. As the name implies, "floating" may refer to a tolerance capability that the radio frequency connector has in an axial direction and/or a radial direction.

In some embodiments, the foregoing radio frequency connector may be further an antenna connector.

DESCRIPTION OF EMBODIMENTS

The following describes technical solutions in embodiments of the present application with reference to accompanying drawings.

Figure 1:
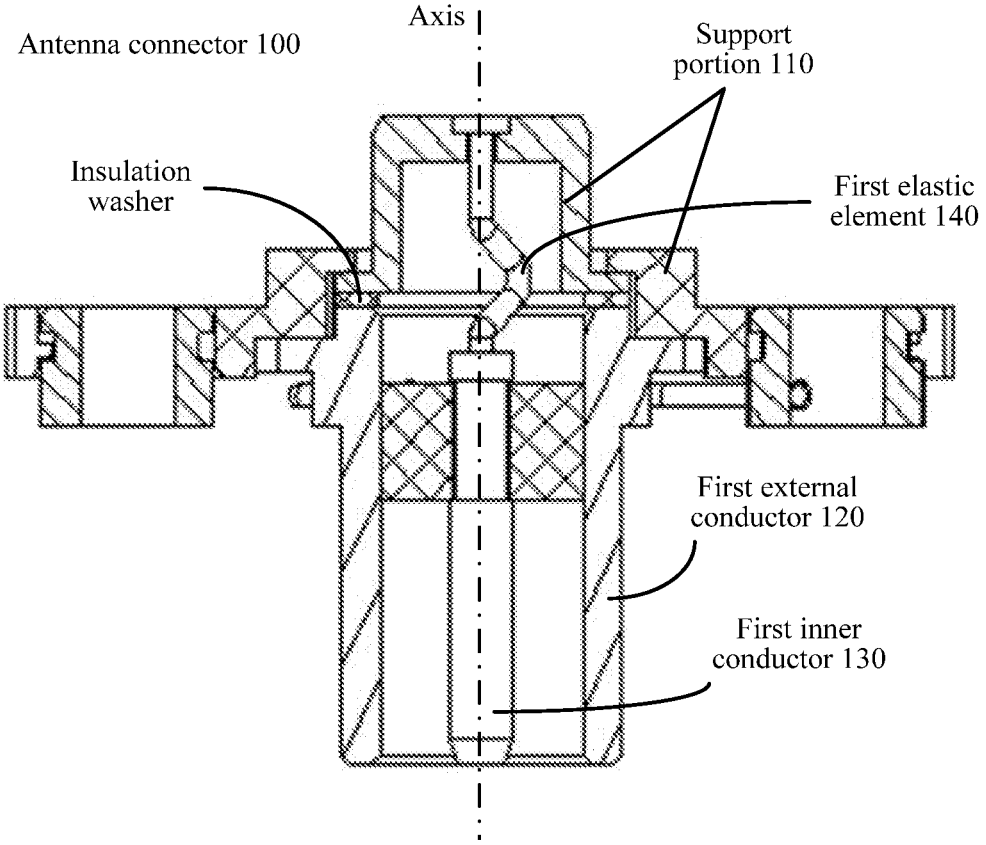
FIG. 1 is a schematic diagram of a radio frequency connector according to an embodiment of this application.

FIG. 1 is a schematic diagram of a radio frequency connector according to an embodiment of this application. FIG. 1 shows only a male connector of the radio frequency connector 100. The radio frequency connector 100 includes:

a support portion 110, where the support portion is disposed in the male connector of the radio frequency connector, and the support portion is configured to connect the male connector of the radio frequency connector to a ground cable of a feeding network;

a first external conductor 120 disposed in the male connector of the radio frequency connector, where the first external conductor is connected to the support portion; and a first inner conductor 130 disposed in the male connector of the radio frequency connector, where the first inner conductor is disposed inside the first external conductor, an axis of the first inner conductor coincides with an axis of the first external conductor, the first inner conductor is connected to the support portion by using a first elastic element 140, and the first inner conductor moves in an axial direction of the external conductor through deformation of the first elastic element.

It should be understood that the foregoing first elastic element may be an elastic rod, a spring, or the like. This is not limited in this embodiment of this application.

The first elastic element is disposed between the first inner conductor and a core sleeve, thereby avoiding a relatively large volume of a housing mounted for the radio frequency connector because of use of a support spring coil for fastening in the prior art, to reduce a volume of the radio frequency connector.

Further, the first elastic element is disposed between the first inner conductor and the core sleeve, to improve a tolerance capability of the male connector of the radio frequency connector and a female connector of the radio frequency connector in an axial direction during assembly, so that the male connector of the radio frequency connector may be connected to the female connector of the radio frequency connector in a manner of blind-mating.

In one embodiment, the foregoing radio frequency connector may be further an antenna connector. The antenna connector supports drawing an antenna without an additional cable connected to the antenna, and helps improve assembly efficiency during assembly of the antenna connector.

The radio frequency connector shown in FIG. 1 includes: the support portion 110, the first external conductor 120 (also referred to as a coaxial external conductor), the first inner conductor 130 (also referred to as a coaxial inner conductor), and the first elastic element 140 (where the elastic rod is used as an example for description). It may be learned from the male connector of the radio frequency connector shown in FIG. 1 that the support portion is connected to the first inner conductor by using the first elastic element. The first inner conductor may move in an axial direction of the axis of the first inner conductor through the deformation of the first elastic element (referring to FIG. 1). When the first elastic element is in a compressed state (referring to a state of the first elastic element shown in FIG. 1), the first inner conductor may be contracted inside the first external conductor. When the first elastic element is in a stretched state, the first inner conductor may extend out of the first external conductor. The axis of the first inner conductor may coincide with the axis of the first external conductor, and the axis of the first inner conductor may coincide with an axis of the support portion.

Because an assembly error of the first inner conductor in the axial direction causes poor contact between the male connector of the radio frequency connector and the female connector of the radio frequency connector, when fit between the male connector of the radio frequency connector and the female connector of the radio frequency connector is improved through the deformation of the first elastic element disposed between the support portion and the first inner conductor, the tolerance capability between the male connector and the female connector of the radio frequency connector in the axial direction is improved.

In one embodiment, the apparatus further includes at least one first fastener. The at least one first fastener is disposed on the first external conductor. A second elastic element is disposed between each of the at least one first fastener and the first external conductor. An axis of the at least one first fastener remains parallel to the axis of the first external conductor through deformation of the second elastic element.

Figure 2:
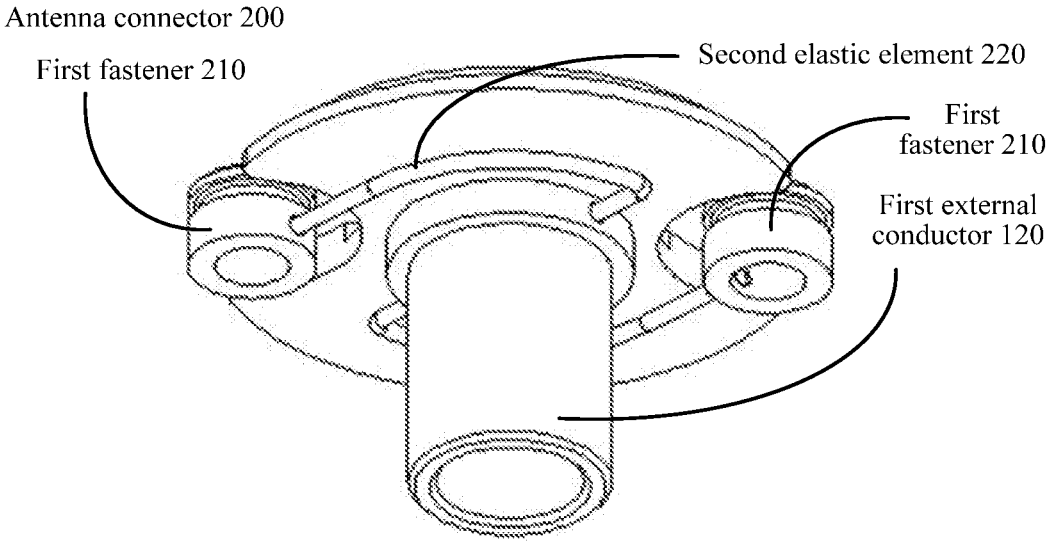
FIG. 2 is a schematic assembly diagram of a radio frequency connector according to an embodiment of this application.

FIG. 2 is a schematic assembly diagram of a radio frequency connector according to an embodiment of this application. It should be understood that a part in the radio frequency connector 200 shown in FIG. 2 that is the same as that in the radio frequency connector 100 shown in FIG. 1 uses the same number. It should be further understood that in the radio frequency connector shown in FIG. 2, only that two first fasteners are disposed on a first external conductor is used as an example for description. It may be learned from the radio frequency connector 300 shown in FIG. 2 that the two first fasteners 210 are disposed on the first external conductor 110, and each of the two first fasteners is connected to the first external conductor by using a second elastic element. A stretched state or a compressed state of the second elastic element may result from a radial offset between the second elastic element and the first external conductor.

It should be understood that the foregoing radial offset may mean that displacement exists between the first fastener and the first external conductor in a radial direction, and the foregoing radial offset may further mean that an included angle exists between an axis of the first fastener and an axis of the first external conductor.

It should be further understood that one or more first fasteners may be disposed on the first external conductor. Each of the foregoing first fasteners may be connected to the first external conductor by using the second elastic element. In other words, a quantity of the first fasteners may be the same as that of second elastic elements. This is not limited in this embodiment of this application.

It should be noted that the second elastic element may be further a U-shaped elastic rod, or may be a spring. This is not limited in this embodiment of this application.

In one embodiment, the support portion includes a support frame and a core sleeve. At least one second fastener is disposed on the support frame. At least one protrusion portion is disposed on each of the at least one second fastener. At least one groove is disposed on each of the at least one first fastener. Each second fastener disposed on the support frame is connected to each first fastener disposed on the first external conductor through fit between the protrusion portion and the groove. The core sleeve is connected to the first external conductor by using the support frame. The core sleeve is connected to the first inner conductor by using the first elastic element.

It should be understood that a quantity of the at least one protrusion portion disposed on the first fastener may be equal to a quantity of the at least one groove disposed on the second fastener.

Figure 3:
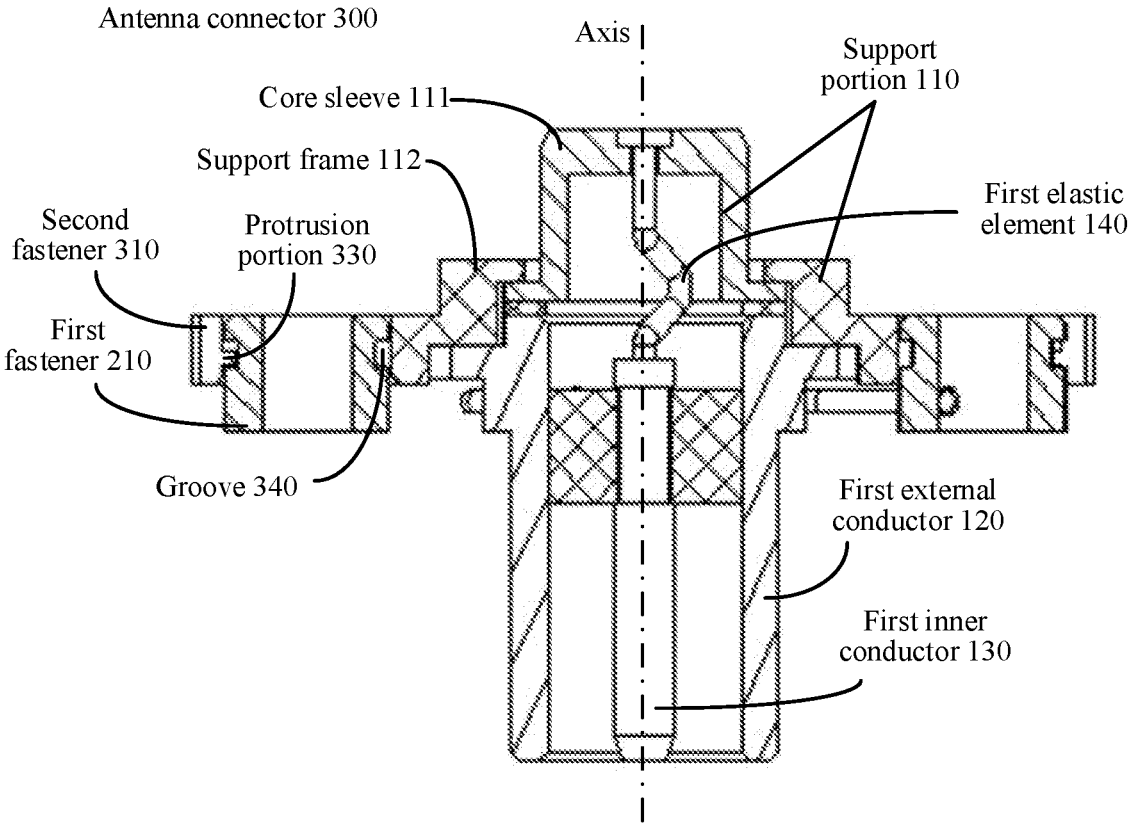
FIG. 3 is a schematic assembly diagram of a radio frequency connector according to an embodiment of this application.

FIG. 3 is a schematic assembly diagram of a radio frequency connector according to an embodiment of this application. It should be understood that a part in the radio frequency connector 300 shown in FIG. 3 that is the same as that in the radio frequency connector 100 shown in FIG. 1 and that in the radio frequency connector 200 shown in FIG. 2 uses the same number. It may be learned from the radio frequency connector 300 shown in FIG. 3 that a support portion 110 includes a core sleeve 111 and a support frame 112. A second fastener may be disposed on the support frame. A first fastener 210 disposed on a first external conductor and the second fastener 310 disposed on the support frame are in an assembly state. In one embodiment, a protrusion portion 330 on the second fastener is locked into a groove 340 disposed on the first fastener.

In one embodiment, the groove disposed on the first fastener and the protrusion portion disposed on the second fastener may be in clearance fit.

In one embodiment, the apparatus further includes a first stop block. The first stop block is disposed between the first external conductor and a first inner conductor, to control the axis of the first inner conductor to coincide with an axis of the first external conductor.

In one embodiment, the first stop block is disposed between the first external conductor and the first inner conductor. The first stop block is configured to fasten the first external conductor and the first inner conductor, so that the axis of the first inner conductor coincides with the axis of the first external conductor.

In one embodiment, the foregoing first stop block may be a medium. The medium is disposed between the first inner conductor and the first external conductor, to support the first inner conductor and the first external conductor, so that the first inner conductor and the first external conductor are coaxial.

It should be noted that the foregoing first stop block may be further a bracket. A fastener for mounting the first inner conductor and a fastener for mounting the first external conductor may be disposed on the bracket. For the first inner conductor and the first external conductor, the axis of the first inner conductor may be enabled to coincide with the axis of the first external conductor through locating of the bracket. A form of the foregoing first stop block is not limited in this embodiment of this application.

Figure 4:
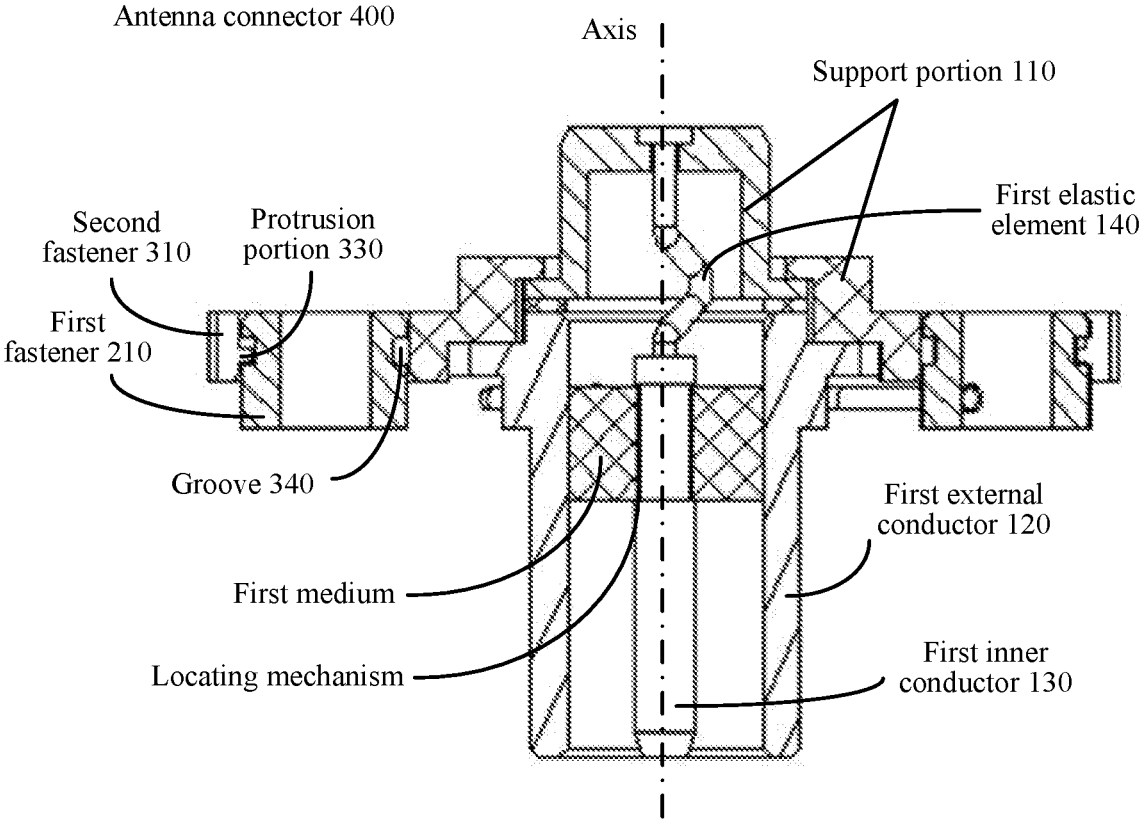
FIG. 4 is a schematic assembly diagram of a radio frequency connector according to an embodiment of this application.

FIG. 4 is a schematic assembly diagram of a radio frequency connector according to an embodiment of this application. A part in the radio frequency connector 400 shown in FIG. 4 that is the same as that in the radio frequency connector 300 shown in FIG. 3 uses the same number. A first medium is used as an example for description of a first stop block in the radio frequency connector 400 shown in FIG. 4. A locating mechanism may be disposed on a first inner conductor. The first inner conductor fastens, by using the locating mechanism, the first medium at a location of the locating mechanism on the first inner conductor. When the first inner conductor moves in an axial direction of an axis, the first medium may be driven to move in the axial direction of the axis, so that the axial of the first inner conductor coincides with an axial of the first external conductor through support of the first medium.

In one embodiment, the apparatus further includes a core connecting piece. The core connecting piece is configured to connect a core sleeve to a signal cable of a feeding network in a radome.

In one embodiment, radio frequency conduction may be performed between the core connecting piece and the signal cable of the feeding network. A conduction manner may be connecting the core connecting piece to the signal cable of the feeding network in a manner of welding, or connecting the core connecting piece to the signal cable of the feeding network in a manner of crimping. This is not limited in this embodiment of this application.

It should be noted that the foregoing feeding network may be a suspended stripline feeding network, or may be a microstrip feeder network. A form of the feeding network is not limited in this application.

It should be further understood that radio frequency conduction may be further performed between the foregoing core connecting piece and the first inner conductor. In one embodiment, radio frequency conduction may be further implemented between the core connecting piece and the first inner conductor in a manner of direct contact or coupled connection. The foregoing manner of direct contact may include connecting the core connecting piece to the first inner conductor in a manner of welding, or connecting the core connecting piece to the first inner conductor in a manner of crimping. This is not limited in this embodiment of this application.

In one embodiment, the foregoing core connecting piece may be a metal piece, or may be a nonmetallic piece on which conductive surface treatment is performed.

Figure 5:
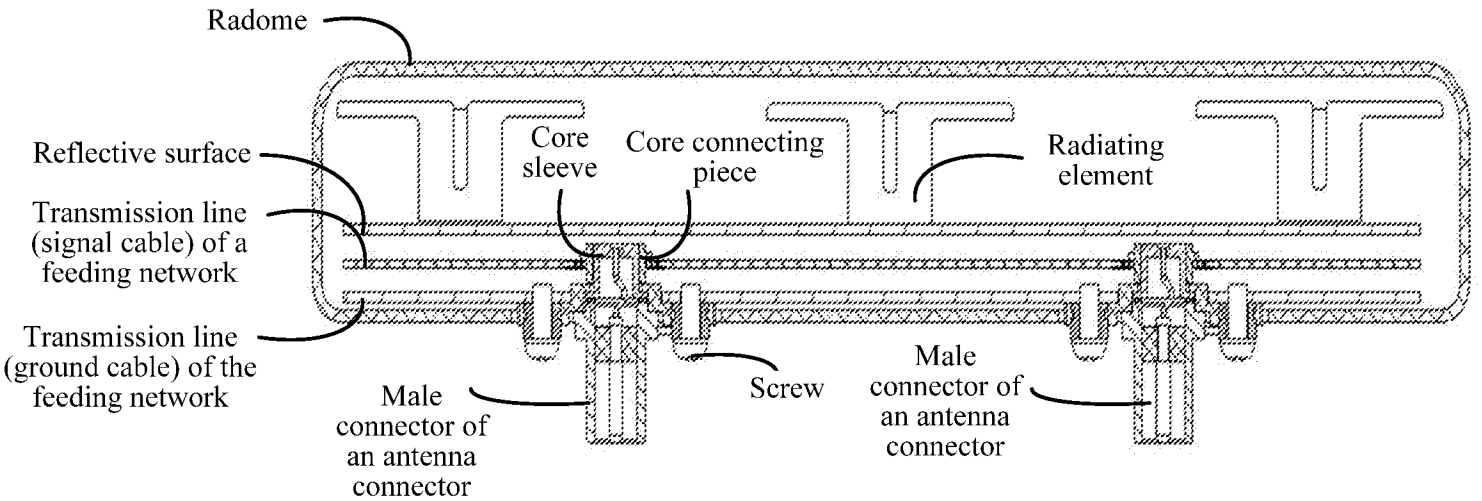
FIG. 5 is a schematic assembly diagram of a male connector of a radio frequency connector and an antenna according to an embodiment of this application.

FIG. 5 is a schematic assembly diagram of a male connector of a radio frequency connector and an antenna according to an embodiment of this application. It should be understood that for a structure of the male connector of the radio frequency connector shown in FIG. 5, refer to the schematic structural diagram of the male connector of the radio frequency connector described in each of FIG. 1 to FIG. 4. For brevity, details are not described again.

A radome shown in FIG. 5 may include at least one radiating element, a reflection panel, transmission lines (a ground cable and a signal cable) of a feeding network, and the like. The male connector of the radio frequency connector may be connected, by using a screw, to the ground cable of the transmission lines of the feeding network that are disposed in the radome. A core sleeve may be connected to the signal cable of the transmission lines of the feeding network by using a core connecting piece. The core connecting piece may be electrically connected to the signal cable of the transmission lines of the feeding network by using a conductor (for example, a metal piece).

It should be noted that the radome may be connected to a radio frequency module by using at least one radio frequency connector. Only that male connectors of two radio frequency connectors are disposed on the radome is used as an example for description in FIG. 5. This is not limited in this embodiment of this application.

In one embodiment, the apparatus further includes an insulation washer. The insulation washer is disposed between the core sleeve and a first external conductor.

In one embodiment, referring to the structural diagram of the male connector of the radio frequency connector shown in FIG. 1, the insulation washer is disposed between the core sleeve and the first external conductor.

In one embodiment, the apparatus further includes: a second external conductor, where the second external conductor is disposed in a female connector of the radio frequency connector; a second inner conductor disposed in the female connector of the radio frequency connector, where the second inner conductor is disposed inside the second external conductor; and a second stop block, where the second stop block is disposed between the second external conductor and the second inner conductor, to control an axis of the second external conductor to coincide with an axis of the second inner conductor.

In one embodiment, the foregoing second stop block may be a second medium. The second medium is disposed between the second inner conductor and the second external conductor. The medium supports the second inner conductor and the second external conductor, so that the axis of the second inner conductor coincides with the axis of the second external conductor.

It should be noted that the foregoing second stop block may be further a bracket. A fastener for mounting the second inner conductor and a fastener for mounting the second external conductor may be disposed on the bracket. For the second inner conductor and the second external conductor, the axis of the second inner conductor may be enabled to coincide with the axis of the second external conductor through locating of the bracket. A form of the foregoing second stop block is not limited in this embodiment of this application.

Figure 6:
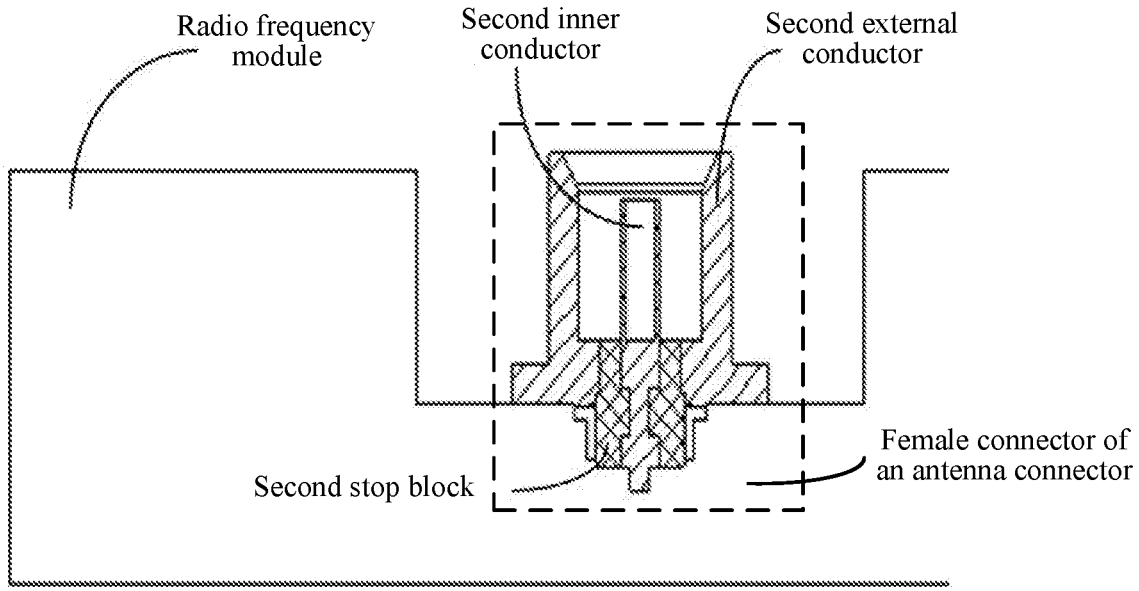
FIG. 6 is an assembly diagram of a female connector of a radio frequency connector and a radio frequency module according to an embodiment of this application.

FIG. 6 is an assembly diagram of a female connector of a radio frequency connector and a radio frequency module according to an embodiment of this application. It may be learned from the assembly diagram shown in FIG. 6 that, the female connector of the radio frequency connector is connected to the radio frequency module in FIG. 6, the female connector of the radio frequency connector includes a second external conductor and a second inner conductor disposed inside the second external conductor, a second stop block may be disposed between the second inner conductor and the second external conductor, and the second stop block is configured to control an axis of the second inner conductor to coincide with an axis of the second external conductor.

In one embodiment, a convex shoulder is disposed on a first external conductor. The convex shoulder is connected to a first fastener by using a second elastic element. The convex shoulder fits the second external conductor, to control axial locations of the first external conductor and the second external conductor.

Figure 7:
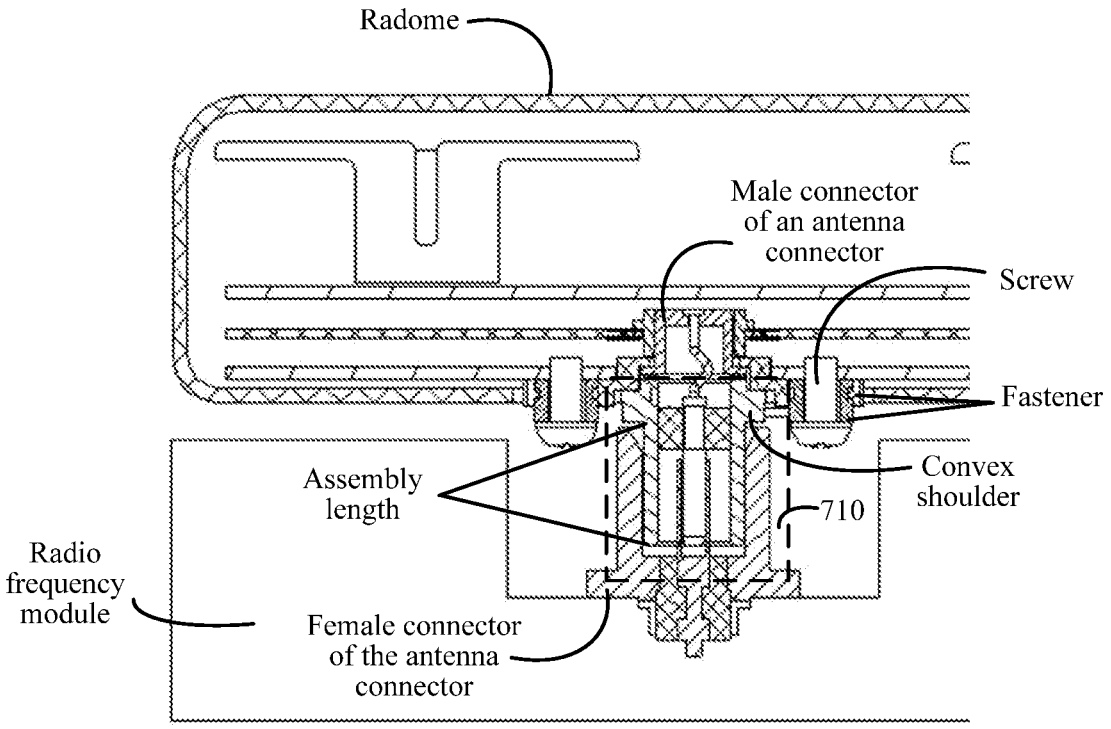
FIG. 7 is an assembly diagram of a male connector of a radio frequency connector and a female connector of the radio frequency connector according to an embodiment of this application.

FIG. 7 is an assembly diagram of a male connector of a radio frequency connector and a female connector of the radio frequency connector according to an embodiment of this application. In the assembly diagram shown in FIG. 7, the male connector of the radio frequency connector that is connected to a ground cable of transmission lines of a feeding network and the female connector of the radio frequency connector that is connected to a radio frequency module are in an assembly state, referring to 710 in FIG. 7. The foregoing assembly state may mean that a first inner conductor on the male connector of the radio frequency connector fits a second inner conductor on the female connector of the radio frequency connector, and in one embodiment, the first inner conductor is inserted into the second inner conductor, and radio frequency connection is implemented between the first inner conductor and the second inner conductor; and that a first external conductor on the male connector of the radio frequency connector fits a second external conductor on the female connector of the radio frequency connector, and in one embodiment, the first external conductor is inserted into the second external conductor, and radio frequency connection is implemented between the first external conductor and the second external conductor.

In one embodiment, the first inner conductor on the male connector of the radio frequency connector extends out of the first external conductor when a first elastic member is in a natural state (subject to no external force). It may be understood that an assembly length (not shown) of the first inner conductor and the first elastic member is greater than an assembly length of the first external conductor and the second external conductor. If the male connector of the radio frequency connector and the female connector of the radio frequency connector are in an assembly state, the first inner conductor first comes into contact with a bottom of the second inner conductor before a convex shoulder disposed on the first external conductor comes into contact with a top of the second external conductor. In this case, the first elastic element is subject to a vertical external force upward from the bottom of the second inner conductor, and therefore the first elastic element is in a compressed state till the convex shoulder disposed on the first external conductor comes into contact with the top of the second external conductor. Therefore, the first elastic element is disposed between the first inner conductor and a core sleeve, to improve a tolerance capability of the male connector of the radio frequency connector and the female connector of the radio frequency connector in an axial direction during assembly, and help improve assembly efficiency during assembly of the radio frequency connector.

When the male connector of the radio frequency connector is connected to a radome by using a screw, connection by using the screw may result in an included angle between an axis of the screw and an axis of the first external conductor. Because the screw is connected to the first external conductor by using a support frame, when assembly has a radial error, the screw may affect a location of the axis of the first external conductor, and further affect coaxiality between the male connector of the radio frequency connector and the female connector of the radio frequency connector during assembly. Therefore, a second elastic element may be disposed between a first fastener and the first external conductor. When the screw and a fastener (used for description of a state occurring after the first fastener fits a second fastener) have an assembly error, the second elastic element may alleviate, through elastic deformation, reduction that is of the coaxiality between the male connector of the antenna connector and the female connector of the antenna connector after assembly and that is caused by the foregoing radial assembly error. In other words, the second elastic element is disposed between the first fastener and the first external conductor, and the tolerance capability of the male connector of the radio frequency connector and the female connector of the radio frequency connector in the axial direction during assembly is improved by using the second elastic element, which helps improve the assembly efficiency during assembly of the radio frequency connector.

It should be understood that in the embodiments of the present application, "B corresponding to A" indicates that B is associated with A, and B may be determined according to A. However, it should be further understood that determining B according to A does not mean that B is determined according to A only; that is, B may also be determined according to A and/or other information.

It should be understood that the term "and/or" in this specification describes only an association relationship for describing associated objects and represents that three relationships may exist. For example, A and/or B may represent the following three cases: Only A exists, both A and B exist, and only B exists. In addition, the character "/" in this specification generally indicates an "or" relationship between the associated objects.

It should be understood that sequence numbers of the foregoing processes do not mean execution sequences in the embodiments of the present application. The execution sequences of the processes should be determined according to functions and internal logic of the processes, and should not be construed as any limitation on the implementation processes of the embodiments of the present application.

A person of ordinary skill in the art may be aware that, in combination with the examples of units and algorithm steps or operations described in the embodiments disclosed in this specification, the embodiments may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present application.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of the present application may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present application essentially, or the part contributing to the prior art, or some of the technical solutions may be implemented in a form of a software product. The computer software product is stored in a storage medium, and includes several instructions for instructing a computer device (which may be a personal computer, a server, a network device, or the like) to perform all or some of the steps or operations of the methods in the embodiments of the present application. The foregoing storage medium includes: any medium that can store program code, such as a USB flash drive, a removable hard disk, a read-only memory (ROM), a random access memory (RAM), a magnetic disk, or a compact disc.

The foregoing descriptions are merely embodiments of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A radio frequency connector comprising:

a support portion disposed in a male connector of the radio frequency connector, the support portion configured to connect the male connector of the radio frequency connector to a ground cable of transmission lines of a feeding network;

a first external conductor disposed in the male connector of the radio frequency connector, the first external conductor connected to the support portion;

a first inner conductor disposed in the male connector of the radio frequency connector, the first inner conductor disposed inside the first external conductor, an axis of the first inner conductor coinciding with an axis of the first external conductor, the first inner conductor connected to the support portion by using a first elastic element, and the first inner conductor moveable in an axial direction of the first external conductor through deformation of the first elastic element; and at least one first fastener, wherein the at least one first fastener is disposed on the first external conductor, and a second elastic element is disposed between each of the at least one first fastener and the first external conductor.

2. The radio frequency connector according to claim 1, wherein the radio frequency connector further comprises:

a first stop block, wherein the first stop block is disposed between the first external conductor and the first inner conductor, to control the axis of the first inner conductor to coincide with the axis of the first external conductor.

3. The radio frequency connector according to claim 1, wherein the first elastic element is an elastic rod.

4. The radio frequency connector according to claim 1, wherein the radio frequency connector further comprises: an axis of the at least one first fastener remaining parallel to the axis of the first external conductor through deformation of the second elastic element.

5. The radio frequency connector according to claim 4, wherein the support portion comprises a support frame and a core sleeve, at least one second fastener is disposed on the support frame, at least one protrusion portion is disposed on each of the at least one second fastener, and at least one groove is disposed on each of the at least one first fastener; and each second fastener disposed on the support frame is connected to each first fastener disposed on the first external conductor through fit between the protrusion portion and the groove, the core sleeve is connected to the first external conductor by using the support frame, and the core sleeve is connected to the first inner conductor by using the first elastic element.

6. The radio frequency connector according to claim 5, wherein the radio frequency connector further comprises:

a core connecting piece, wherein the core connecting piece is configured to connect the core sleeve to a signal cable of the feeding network in an antenna.

7. The radio frequency connector according to claim 5, wherein the radio frequency connector further comprises:

an insulation washer, wherein the insulation washer is disposed between the core sleeve and the first external conductor.

8. The radio frequency connector according to claim 1, wherein the radio frequency connector further comprises:

a second external conductor, wherein the second external conductor is disposed in a female connector of the radio frequency connector;

a second inner conductor disposed in the female connector of the radio frequency connector, wherein the second inner conductor is disposed inside the second external conductor; and a second stop block, wherein the second stop block is disposed between the second external conductor and the second inner conductor, to control an axis of the second external conductor to coincide with an axis of the second inner conductor.

9. The radio frequency connector according to claim 8, wherein a convex shoulder is disposed on the first external conductor, and the convex shoulder is connected to the first fastener by using the second elastic element; and the convex shoulder fits the second external conductor, to control axial locations of the first external conductor and the second external conductor.

10. A radio frequency connector comprising:

a support portion disposed in a male connector of the radio frequency connector, the support portion configured to connect the male connector of the radio frequency connector to a ground cable of transmission lines of a feeding network;

a first external conductor disposed in the male connector of the radio frequency connector, the first external conductor connected to the support portion;

a first inner conductor disposed in the male connector of the radio frequency connector, the first inner conductor disposed inside the first external conductor, an axis of the first inner conductor coinciding with an axis of the first external conductor, the first inner conductor connected to the support portion by using a first elastic element, and the first inner conductor moveable in an axial direction of the first external conductor through deformation of the first elastic element, wherein the first elastic element is an elastic rod;

a first stop block disposed between the first external conductor and the first inner conductor to control the axis of the first inner conductor to coincide with the axis of the first external conductor; and at least one first fastener disposed on the first external conductor, wherein a second elastic element is disposed between each of the at least one first fastener and the first external conductor, and an axis of the at least one first fastener remains parallel to the axis of the first external conductor through deformation of the second elastic element.

11. The radio frequency connector according to claim 10, wherein the support portion comprises a support frame and a core sleeve, at least one second fastener is disposed on the support frame, at least one protrusion portion is disposed on each of the at least one second fastener, and at least one groove is disposed on each of the at least one first fastener; and each second fastener disposed on the support frame is connected to each first fastener disposed on the first external conductor through fit between the protrusion portion and the groove, the core sleeve is connected to the first external conductor by using the support frame, and the core sleeve is connected to the first inner conductor by using the first elastic element.

12. The radio frequency connector according to claim 11, wherein the radio frequency connector further comprises:

a core connecting piece, wherein the core connecting piece is configured to connect the core sleeve to a signal cable of the feeding network in an antenna.

13. The radio frequency connector according to claim 11, wherein the radio frequency connector further comprises:

an insulation washer, wherein the insulation washer is disposed between the core sleeve and the first external conductor.

14. The radio frequency connector according to claim 10, wherein the radio frequency connector further comprises:

a second external conductor, wherein the second external conductor is disposed in a female connector of the radio frequency connector;

a second inner conductor disposed in the female connector of the radio frequency connector, wherein the second inner conductor is disposed inside the second external conductor; and a second stop block, wherein the second stop block is disposed between the second external conductor and the second inner conductor, to control an axis of the second external conductor to coincide with an axis of the second inner conductor.

15. The radio frequency connector according to claim 14, wherein a convex shoulder is disposed on the first external conductor, and the convex shoulder is connected to the first fastener by using the second elastic element; and the convex shoulder fits the second external conductor, to control axial locations of the first external conductor and the second external conductor.

* * * * *